United States Patent [19]

Prince

[11] 4,062,070

[45] Dec. 13, 1977

[54] TOILET URINE DEFLECTOR

[76] Inventor: Paul R. Prince, 15960 Maidstone St., Fountain Valley, Calif. 92708

[21] Appl. No.: 728,874

[22] Filed: Oct. 1, 1976

[51] Int. Cl.[2] ..... E03D 11/00

[52] U.S. Cl. ..... 4/1; 4/139

[58] Field of Search ..... 4/1, 109, 139, 231; 35/29 E

[56] References Cited

U.S. PATENT DOCUMENTS

| | | | |
|---|---|---|---|
| 294,758 | 3/1884 | Catlin | 4/231 |
| 1,144,660 | 6/1915 | McKnight | 4/139 |
| 2,703,407 | 3/1955 | Henoch et al. | 4/1 |
| 2,838,763 | 6/1958 | Brennan | 4/1 |

FOREIGN PATENT DOCUMENTS

| | | | |
|---|---|---|---|
| 403,216 | 6/1966 | Switzerland | 4/1 |

*Primary Examiner*—Charles E. Phillips

[57] ABSTRACT

A toilet bowl system with a floating and self-rinsing deflector for receiving and noiselessly dispersing urine into the water located in the bottom of said toilet bowl.

5 Claims, 6 Drawing Figures

Fig. 1.
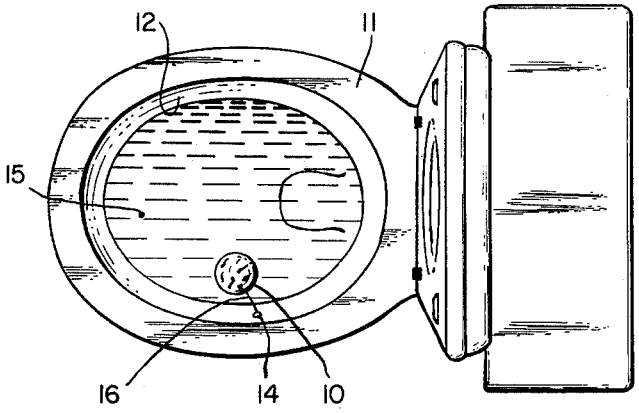
Fig. 3.
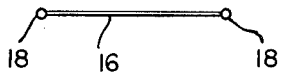
Fig. 2.
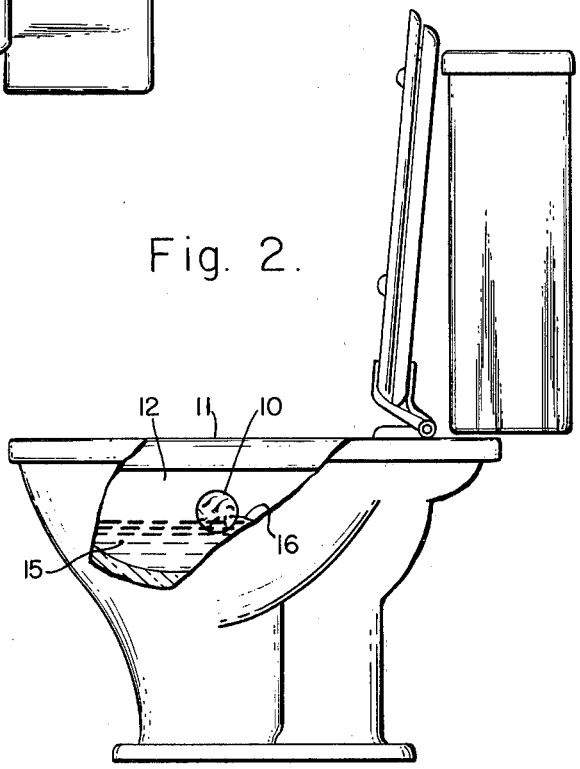
Fig. 4.
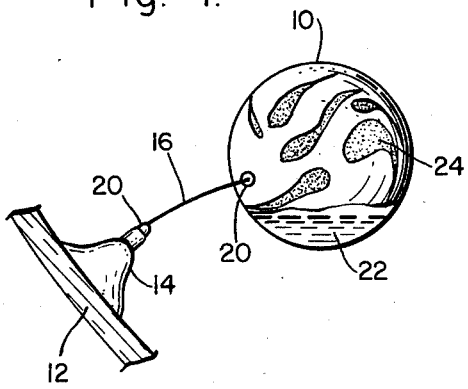
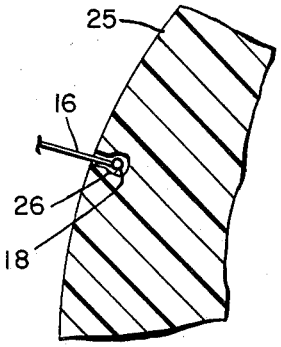
Fig. 5.
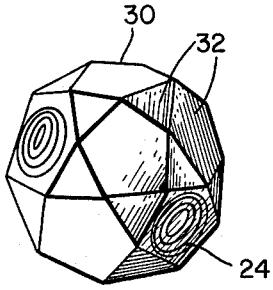
Fig. 6.

TOILET URINE DEFLECTOR

BACKGROUND OF THE INVENTION

1. Field of the Invention

This invention relates to toilets used as male urinals and provides low cost and effective urination noise reduction and splash reduction without undue complexity and with self-rinsing features.

The use of a common toilet or water closet as a male urinal has the well known disadvantage of creating loud and often embarrasing noise when the urine stream makes contact with the toilet bowl water. A common practice is to attempt to prevent the noise by directing the urine stream against the inner wall at the back or side which is located within a small angle and at a small distance from the toilet bowl rim. When thus directed, a certain amount of the urine lands substantially outside of the toilet bowl on the rim or at the back, and on the floor. This result requires unnecessary cleanup effort and creates an odorous and unsanitary condition.

2. Description of the Prior Art

Each of the various prior art urination noise or splash suppression devices addresses the noise problem with screens, baffles, troughs, and the like, attached to the toilet bowl rim or seat. These devices provide additional surfaces, crevices, hinges, screws, and screens which require periodic cleaning and are relatively expensive to produce.

A simple system such as a smooth floating object like a sphere or polyhedron that is sufficiently large to provide a substantial target at which to aim the urine stream and one that is also smooth and self-rinsing and remains relatively clean would be a substantial advantage to the art, particularly if it did not unduly inhibit the normal toilet bowl flushing or cleaning procedures.

SUMMARY OF THE INVENTION

The system of this invention is a urine deflector floating in the water of a toilet bowl. The deflector location is at a significant angle and a significant distance away from the toilet bowl rim to insure that substantially all of the urine in the urine stream is captured by the toilet bowl, and the system insures that the deflector rinses itself and remains relatively clean. The deflector, though floating, substantially not repelled by an impinging urine stream. The device is reliable and inexpensive.

It is therefore an object of this invention to provide an easily deployed and inexpensive device which will noiselessly disperse a urine stream, said device placeable in the toilet bowl water and thus away from the rim so that substantially all urine in said urine stream is captured by said toilet bowl.

It is an other object of this invention to provide a sanitary urine deflector which is substantially smooth and self-rinsing and remains relatively clean.

It is another object of this invention to provide an improved toilet with a floating noise and splash reducing deflector dynamically arranged to allow the maintainence of urine stream contact thereon with ease.

It is yet another object of this invention to provide a reliable urine deflector large enough to prevent its flushing and to provide a substantial target, and one that is visually interesting so that both men and boys will be inclined to use said deflector consistantly.

BRIEF DESCRIPTION OF THE DRAWINGS

These and other objects, features, and advantages of this invention, as well as the invention itself, will be better understood from the accompanying descriptions taken in connection with the accompanying drawings wherein like reference numerals indicate like or corresponding parts throughout the several views wherein:

FIG. 1 is a top view of the system of the invention showing one embodiment of the device installed in the toilet bowl 12 and floating on the water 15 therein;

FIG. 2 is a side view of the toilet with a side wall of the bowl cutout to illustrate a side view of the device installed;

FIG. 3 is a drawing of a connector 16 which is a restraining means that connects the deflector 10 to an attachment means;

FIG. 4 is a drawing of the assembled device of one preferred embodiment showing a suction cup 14 which is an attachment means, and a weighting fluid 22 within the deflector 10;

FIG. 5 illustrates a cross-sectional view of a part of a cast deflector 25 with an additional attachment feature employing a swivel means, said deflector cast of a substantially uniform density material; and FIG. 6 illustrates an alternative embodiment of the device of the invention showing a polyhedral deflector 30 to be used in conjunction with toilets.

DESCRIPTION OF THE PREFERRED EMBODIMENT

An embodiment of the invention shown as installed in FIGS. 1 and 2 includes a floating deflector 10 attached to the wall of a toilet bowl 12 with a suction cup 14 attachment means and a connector 16 restraining means. The deflector 10 thus located and floating upon the water 15 is sufficiently far from the toilet bowl rim 11 to insure that substantially all urine in a urine stream impinging thereon is captured by the toilet bowl 12. The attachment means 14 can be a common suction cup, the footing of which can be approximately one inch in diameter, attached above or below the water line.

FIG. 3 depicts a connector 16 which may be made of a nylon material and may be approximately one inch in length and made from 0.030 inch diameter stock. Small beads 18 at each end may be melted with heat such as from a glowing hot wire. The beads provide bonding grip regions for cement 20 such as epoxy shown in FIG. 4. Alternatively the connector 16 may be moded into the deflector 10. Theseconfigurations allow the deflector 10 while in use to place the connector 16 in torsional strain, winding it up thereby, so that immediately after use the deflector 10 unwinds and rinses itself. The torsional strain is in the twist direction.

It should be recognized that if provision is made for substantially free slippage at either end of the connector 16, through the use of a swivel such as the type shown in FIG. 5, the connector will not tightly wind up but the cast deflector 25 will even so rinse itself since it will rotate while in use.

This cast deflector 25 and swivel of FIG. 5 may be constructed by first waxing with paste wax and coating the deflector end of the connector 16 and bead 18 with a semi-permanent mold release agent such as a fluorocarbon dispursion. Secondly the coated connector 16 may be cast one-half inch for example into the cast deflector 25 which may be fabricated of a self skinning polyurethane foam. The casting may be accomplished by placing the correct weight of foam ingredients such as 2 ounces for a 3 inch diameter sphere into a two piece mold of an acceptable material such as aluminum with provision for escape of entrapped air, and with provision for the connector 16, thereafter clamping the mold. These techniques are well known to those experienced in the art. Thirdly, after removal from the mold, the assembly of FIG. 5 may be complete by pulling and twisting the connector 16 with respect to the cast deflector 25 using a force of approximately 10 pounds, creating a cavity 26 which provides clearance and a resulting inexpensive swivel.

The materials of all parts may be constructed of substances with substantially long life in the mild acid environment of urine and the environment of various toilet and drain cleaners, some of which may be strongly alkaline. The deflector 10 may be constructed of a sound deadening material such as polyurethane or a ceramic and may be three inches in diameter, and may be weighted internally so that it weights approximately 2 ounces. An internal weighting material 22 such as water shown in FIG. 4 may be used to bring the overall density of the spherical deflector 10 to about 15 pounds per cubic foot which is a specific gravity of about 0.24 to cause a substantial fluid damping or drag to maintain stability while in use. The deflector 10 may have interesting multicolored designs, names, and symbols 24 on its surface and may be other than spherical, such as cylindrical or multisided.

FIG. 6 illustrates another embodiment consistant with this invention that, when used as a urine deflector in toilets used as male urinals, satisfies the objects of this invention and may be used with or without a restraining means. A multisided object such as the polyhedral deflector 30 illustrated disperses urine quietly while insuring that substantially all urine can be captured by the toilet bowl. The polyhedral deflector 30 may be made of expanded polystyrene foam with a very smooth non-stick surface coating such as a high gloss polyurethane varnish overcoated with a fluorohydrocarbon lubricant, allowing its acceptable use anywhere within the toilet bowl, floating upon the water therein. The surface facets 32 provide a water wheel effect so that while in use the polyhedral deflector 30 rotates and thereby self-rinses. The edges of the facets provide a bracing means at the end of the toilet flush cycle to hold the polyhedral deflector 30 away from the drain so that the remaining fluid can pass between the lower toilet bowl walls and the deflector facets. This action may be provided for example with a 32 sided polyhedron such as the truncated regular dodecahedron illustated in FIG. 6 weighing about 0.7 ounce and having a major diagonal of about 3 ⅜inches and used in a common toilet with a drain of about three inches or less clearance. The dynamics of such multifaceted solids are substantially different from the dynamics of cylinders or spheres which tend to move away from an impinging urine stream, requiring a stabilizing weighting means 22 previously discussed in connection with deflector 10. The polyhedral deflector 30 has an opposite dynamic reaction to impinging fluid streams at acceptable angels in that the water wheel effect creates rotation toward the stream and the facets serve as water paddles acting on the toilet bowl water so that the polyhedral deflector 30 has a tracking effect and thereby tends to follow a urine stream as it is directed around.

Normally the urine stream is directed to the side of the deflector to cause it to spin. However when the stream makes contact substantially perpendicular to a polyhedral deflector surface there may be a back splash. A secondary splash is that portion of the back splash that is not captured by the toilet bowl 12. This problem establishes two design constraints upon the polyhedral deflector 30. The number of facets should be large, such as thirty two, rather than twelve, for example, providing smaller facets so that the available substantially perpendicular area to any urine stream is small and therefore provides a low probability of back splash. The second constraint involves weight and therefore the height of the polyhedral deflector floating in the toilet bowl water. A density of about four and three-fourths pounds per cubic foot minimizes any secondary splash while insuring that the polyhedral deflector 30 floates atop the water and is therefore substantially the last object to be drawn toward the drain. It thus does not interfere with flushing.

The polyhedral deflector 30 is likewise interesting to use and can be decorated with symbols, names, and/or markings 24. The deflector 10, cast deflector 25, or the polyhedral deflector 30 may include visible radiating means such as glowing paint or an internal illuminator and an energy source to provide visibility in the dark, or may be made of a perishable deodorizing and/or sanitizing material, all within the spirit and scope of this invention.

Although selected preferred embodiments have been described herein with particularity, it is understood that many changes or modifications thereto may be made without departing from the scope of the subject invention.

What is claimed is:

1. A self-rinsing toilet bowl device for reducing urine stream noise and splash comprising:

a free floating and unrestrained deflector for dispursing a urine stream quietly into the toilet bowl water, said deflector weighted for a specific gravity to cause said deflector to float substantially atop said toilet bowl water yet remain relatively low on the water surface for reduced splash; and said deflector having a substantially non-stick coating applied thereon, allowing the acceptable use of said, said deflector comprising a multifaceted object having at least twelve sides to produce a water wheel and water paddle effect to cause said deflector to track and follow said wine stream deflector anywhere within said toilet bowl.

2. The device of claim 1 wherein said deflector is limited in size to the extent that said deflector is only sufficiently large to prevent entrapment in the drain of said toilet bowl.

3. A urine receiving system for reduced noise and splash, comprising:

a flushable toilet bowl with water and a drain of predetermined size;

a floating and unrestrained deflector for dispersing urine quietly into the water of said toilet bowl, said deflector having a size selected to inhibit entrapment in said drain during flushing, and coated to provide a substantially non-stick surface, said deflector comprising a multifaceted object having at least twelve sides to produce a water wheel and water paddle effect to cause said deflector to track and follow said urine stream.

4. The system of claim 3 wherein said deflector is weighted to insure that while said deflector does not inhibit flushing of the toilet, said deflector substantially minimizes secondary splash.

5. The system of claim 4 wherein said deflector is shaped as a polyhedron, said facets allow passage of fluids during flushing of said toilet while the edges of said facets provide bracing means against the walls of said drain, and the passage of said fluids provides cleaning and self-rinsing of said deflector.

* * * * *

UNITED STATES PATENT OFFICE

CERTIFICATE OF CORRECTION

Patent No. 4,062,070 Dated December 13, 1977

Inventor(s) Paul R. Prince

It is certified that error appears in the above-identified patent and that said Letters Patent are hereby corrected as shown below:

Column 1, lines 45-49 should read

-- of the urine in the urine stream is captured by the toilet bowl, and the system insures that the deflector rinses itself and remains relatively clean. The deflector, though floating, is substantially not repelled by an impinging urine stream. The device is reliable and inexpensive. --.

Column 4, lines 44-49 should read

-- applied thereon, allowing the acceptable use of said deflector anywhere within said toilet bowl, said deflector comprising a multifaceted object having at least twelve sides to produce a water wheel and water paddle effect to cause said deflector to track and follow said urine stream. --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*